US008802962B2

(12) United States Patent
Gulak

(10) Patent No.: US 8,802,962 B2
(45) Date of Patent: Aug. 12, 2014

(54) FOOT ACTUATED PERCUSSION BOARD

(71) Applicant: Loren R. Gulak, Wilmington, NC (US)

(72) Inventor: Loren R. Gulak, Wilmington, NC (US)

( * ) Notice: Subject to any disclaimer, the term of this patent is extended or adjusted under 35 U.S.C. 154(b) by 0 days.

(21) Appl. No.: 13/932,054

(22) Filed: Jul. 1, 2013

(65) Prior Publication Data

US 2014/0000445 A1 Jan. 2, 2014

Related U.S. Application Data

(60) Provisional application No. 61/666,891, filed on Jul. 1, 2012.

(51) Int. Cl.
*G10H 1/32* (2006.01)
*G10H 3/00* (2006.01)

(52) U.S. Cl.
USPC ..... 84/746

(58) Field of Classification Search
USPC ..... 84/721, 744, 426, 225
See application file for complete search history.

(56) References Cited

U.S. PATENT DOCUMENTS

| | | | | |
|---|---|---|---|---|
| 3,439,568 | A * | 4/1969 | Griffith | 84/600 |
| 3,510,566 | A | 5/1970 | McKenzie | |
| 3,956,958 | A * | 5/1976 | Nash et al. | 84/687 |
| 4,242,937 | A | 1/1981 | Pozar | |
| 4,245,539 | A * | 1/1981 | Jones | 84/672 |
| 4,491,050 | A * | 1/1985 | Franzmann | 84/746 |
| 4,744,279 | A * | 5/1988 | Livingston | 84/746 |
| 4,984,498 | A | 1/1991 | Fishman | |
| 5,063,821 | A * | 11/1991 | Battle | 84/723 |
| 5,391,830 | A * | 2/1995 | Nishino et al. | 84/626 |
| 5,550,321 | A * | 8/1996 | Brann | 84/721 |
| 5,602,354 | A | 2/1997 | Martin | |
| 5,627,336 | A * | 5/1997 | Stevens | 84/746 |
| 5,866,829 | A * | 2/1999 | Pecoraro | 84/177 |
| 5,866,836 | A * | 2/1999 | Bergstrom | 84/736 |
| 5,878,359 | A * | 3/1999 | Takeda | 701/29.2 |
| 6,215,055 | B1 * | 4/2001 | Saravis | 84/422.1 |
| 6,369,308 | B1 * | 4/2002 | Orr | 84/422.1 |
| 6,979,770 | B2 * | 12/2005 | Hampton, Jr. | 84/723 |
| 7,015,391 | B2 | 3/2006 | Tomoda | |
| 7,115,805 | B1 * | 10/2006 | Vandervoort | 84/422.1 |
| 7,470,847 | B2 * | 12/2008 | Kitagawa | 84/422.1 |
| 7,488,887 | B2 | 2/2009 | Mori | |

(Continued)

FOREIGN PATENT DOCUMENTS

EP 2437253 4/2012

*Primary Examiner* — Jeffrey Donels
(74) *Attorney, Agent, or Firm* — Humphries & King, PC; Mark S. King

(57) ABSTRACT

The present invention is a device for use on a playing surface by a musician using a foot to generate an electrical signal indicative of a bass drum. The device generally comprises a body having a horizontally disposed base, a pivot body secured to the bottom surface of the base, and a strike body secured to the base. The pivot body is adapted to rest upon playing surface allowing body to pivot relative to the playing surface between a first position where the strike body is off the playing surface and a second position where the strike body hits or impacts the playing surface. The device further comprises electronic sensing circuitry adapted to generate an electrical signal indicative of a base drum in response to the strike body hitting the playing surface.

18 Claims, 9 Drawing Sheets

(56) References Cited

U.S. PATENT DOCUMENTS

| | | | | |
|---|---|---|---|---|
| 7,608,776 | B2 * | 10/2009 | Ludwig | 84/721 |
| 7,754,956 | B2 * | 7/2010 | Gain et al. | 84/615 |
| 8,258,392 | B2 | 9/2012 | Mori | |
| 8,373,052 | B2 * | 2/2013 | Yoshino | 84/411 M |
| 8,546,676 | B2 * | 10/2013 | Hashimoto | 84/721 |
| 2007/0234888 | A1 * | 10/2007 | Rotolo de Moraes | 84/730 |
| 2012/0073425 | A1 * | 3/2012 | Hashimoto | 84/746 |
| 2013/0167709 | A1 * | 7/2013 | Gibson | 84/746 |

* cited by examiner

FOOT ACTUATED PERCUSSION BOARD

CROSS-REFERENCE TO RELATED APPLICATIONS

This application claims priority to U.S. Provisional Application Ser. No. 61/666,891 filed on Jul. 1, 2012, now pending, which is hereby incorporated in its entirety into this specification.

BACKGROUND OF THE INVENTION

Stomp boxes are widely used by musicians to add a sound of a bass drum while playing an instrument such as a guitar. Conventional stomp boxes are played by the musician tapping her foot on the box that causes a vibration sensor to generate an electrical signal similar to a bass drum. Conventional stomp boxes have several drawbacks. First, conventional stomp boxes do not match the sound wave signature of an actual bass drum being struck by a foot pedal beater. Second, repetitive tapping by the musician on the box may cause strain in the musician's shin and/or ankle. Third, some musicians have difficultly controlling the frequency or rhythm of the tapping because contact between the foot and stomp box is lost thereby increasing the risk of an undesired sound.

SUMMARY OF THE INVENTION

One object of the present invention is to provide a foot actuated musical device that allows a musician to generate a sound that closely matches the sound of an actual bass drum.

Another object of the present invention is to provide a foot actuated musical device that is ergonomically designed to reduce strain on the musician's shin and ankle so the musician can play the device comfortably for long periods of time.

Another object of the present invention is to provide a foot actuated musical device that allows the musician's foot to remain in constant contact with the device thereby providing a more controlled rhythm like an actual foot pedal of a bass drum.

Another object of the present invention is to provide musicians with a simple, lightweight, and easily transportable device to provide a high quality non-prerecorded bass drum sound in their music.

The present invention is a device for use on a playing surface by a musician using a foot to generate an electrical signal indicative of a bass drum. The device generally comprises a body having a horizontally disposed base, a pivot body secured to the bottom surface of the base, and a strike body secured to the bottom surface of the base. The pivot body is adapted to rest upon the playing surface allowing the base and body to pivot relative to the playing surface between a first position where the strike body is off the playing surface and a second position where the strike body hits or strikes the playing surface. The device further comprises electronic sensing circuitry adapted to generate an electrical signal indicative of a base drum in response to the strike body hitting the playing surface.

BRIEF DESCRIPTION OF THE DRAWINGS

The following description of the invention will be more fully understood with reference to the accompanying drawings in which.

DESCRIPTION OF THE INVENTION

Figure 1:
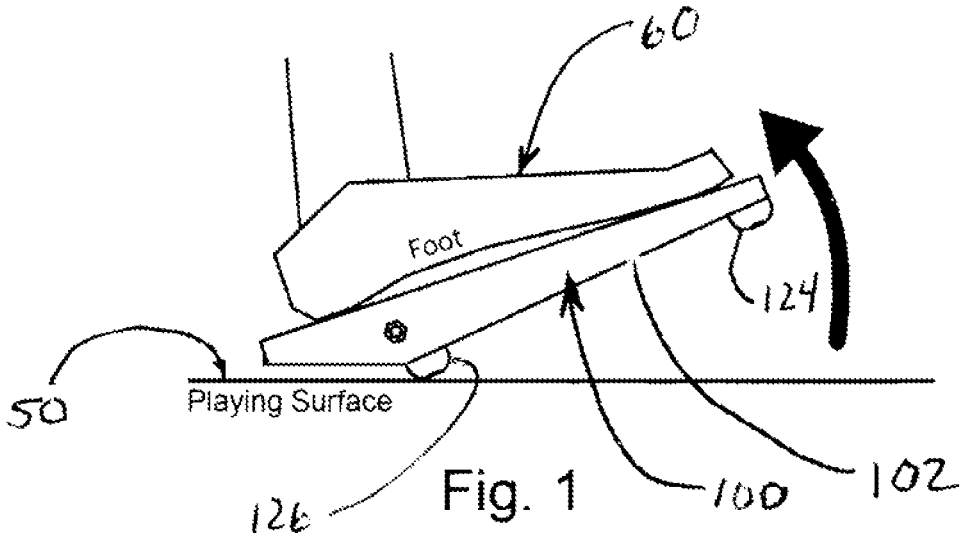
FIG. 1 is a side view of a device according to a first embodiment of the present invention showing a musician's foot pivoting a strike body of the device off or above a playing surface.
Figure 2:
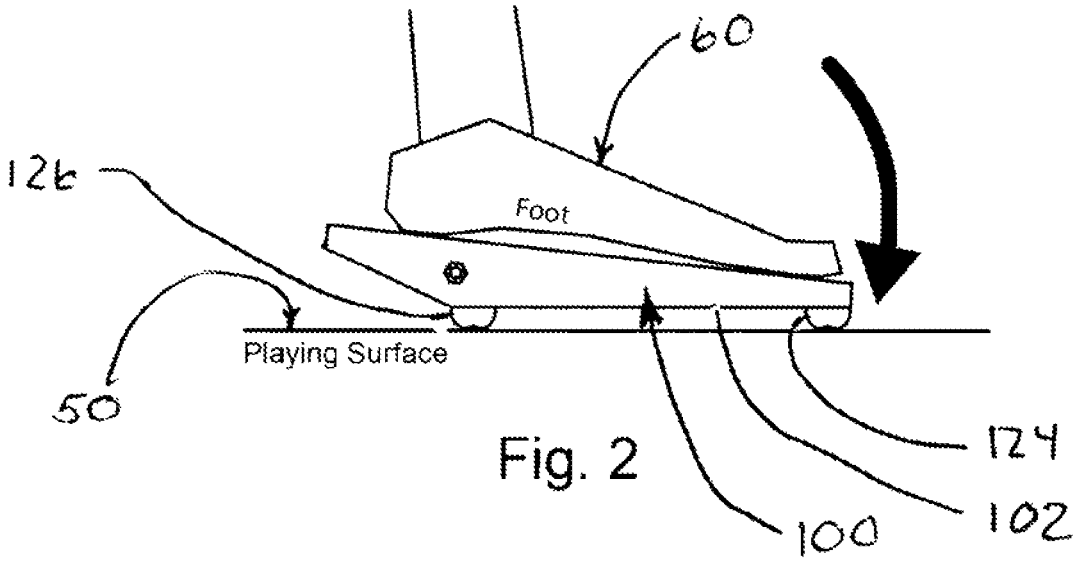
FIG. 2 is a side view of the device according to the first embodiment of the present invention showing a musician's foot pivoting the device so the strike body hits or strikes the playing surface.

Referring to FIGS. 1 and 2, a device 100 according to a first embodiment of the present invention is shown for use on a playing surface 50 by a musician (not shown) having a foot 60 to generate an electrical signal indicative of a bass drum. Device 100 generally comprises a body 102, a strike body 124, and a pivot body 126 adapted to rest upon playing surface 50 allowing body 102 to pivot relative to playing surface 50 between a first position where strike body 124 is off playing surface 50 (FIG. 1) and a second position where strike body 124 hits or impacts playing surface 50 (FIG. 2). Device 100 further comprises electronic sensing circuitry 130 (to be described) engaged with body 102 and adapted to generate an electrical signal indicative of a base drum in response to strike body 124 hitting playing surface 50.

Figure 3:
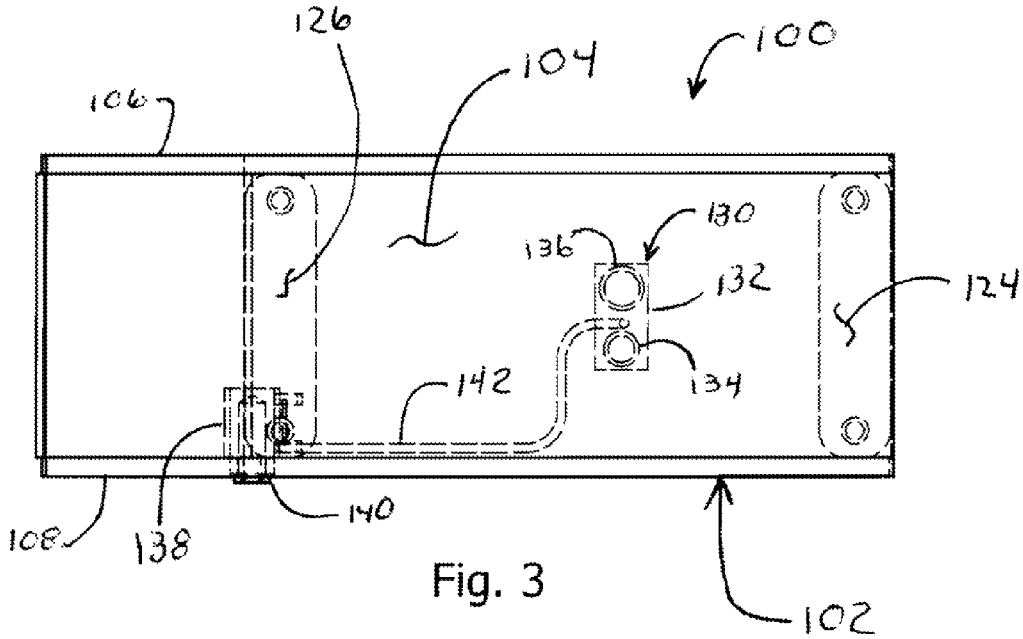
FIG. 3 is a top plan view of the device according to the first embodiment of the present invention.
Figure 4:
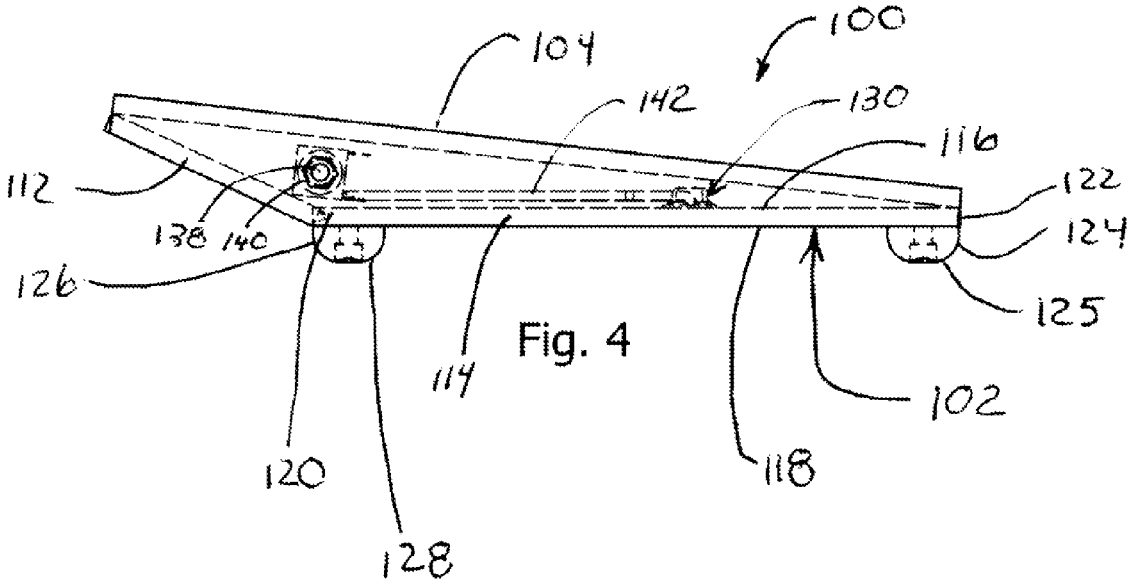
FIG. 4 is a side view of the device according to the first embodiment of the present invention.
Figure 5:
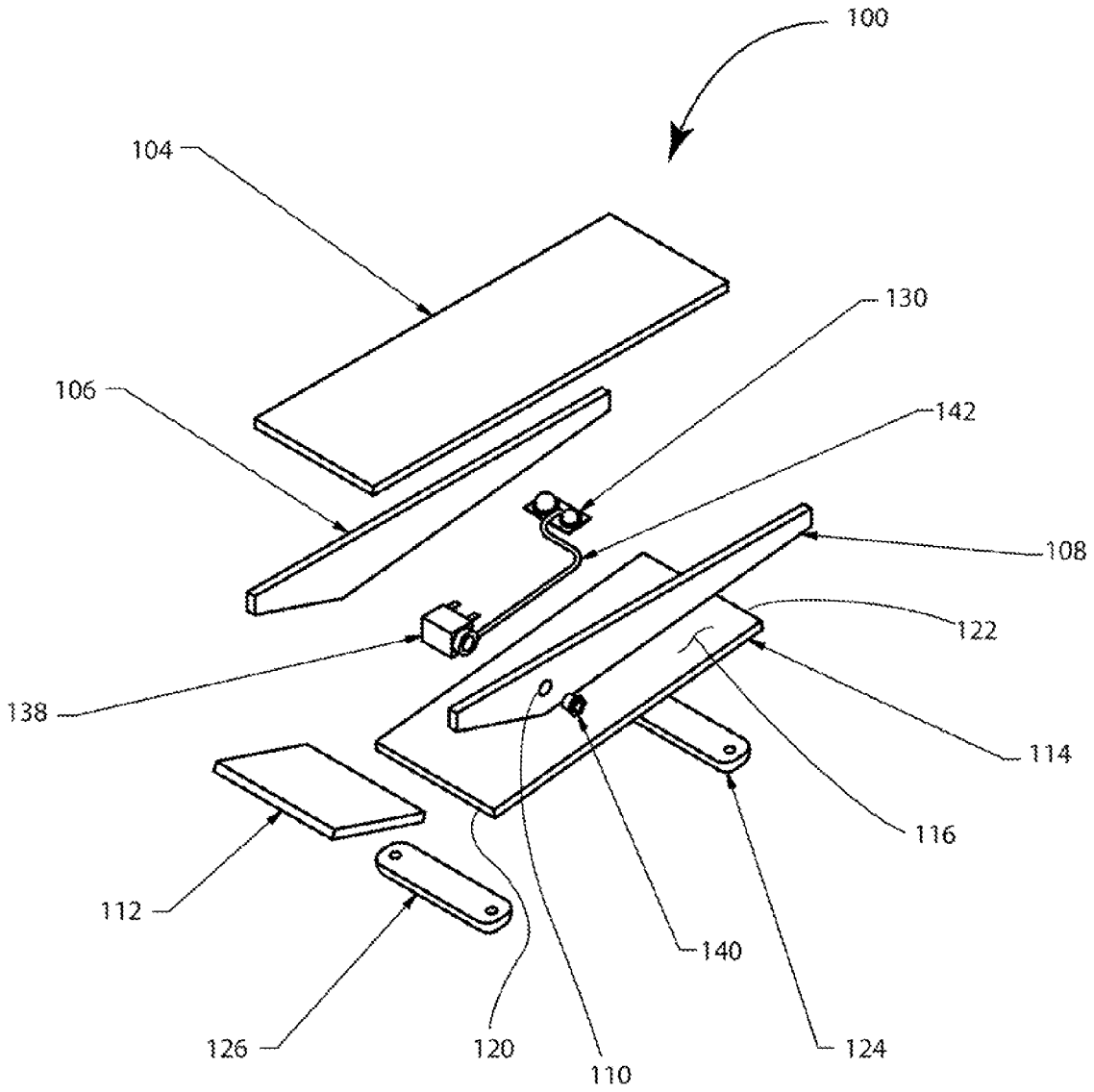
FIG. 5 is an exploded view of the device according to the first embodiment of the present invention.

Referring to FIGS. 3-5, body 102 generally comprises a foot board 104, side boards 106 and 108, a back board 112, and a base 114. Side board 108 has an opening 110 adapted to receive an audio jack (to be described). Base 114 comprises a top surface 118, a bottom surface 118, and first and second ends 120 and 122. Side boards 106 and 108, and back board 112, are engaged with or secured to base 118 by conventional fasteners such as screws or glue (not shown). Foot board 104 is engaged with or secured to side boards 106 and 108 and second end 122 of base 114 by conventional fasteners means such as screws (not shown).

Foot board 104 is inclined about ten (10) degrees relative to base 114 beginning at end 122 and extending beyond or outward of first end 120 of base 114 to provide an ergonomic structure for the musician's foot to rest upon and rock to pivot base 114 and body 102 relative to playing surface 50. Body 102 has an maximum overall height of about two (2) inches measured from base 114 to the highest point on foot board 104. Foot board 104, side boards 106 and 108, back board 112 and base 114 are made from wood and fabricated by conventional wood forming, cutting, and machining processes. Foot board 104, side boards 106 and 108, back board 112 and base 114 may be made from other materials such as metal or plastic.

With continued reference to FIGS. 3-5, strike body 124 is secured to bottom surface 118 of base 114 inward of second 122 by conventional means such as screws (not shown). Strike body 124 spans the entire width of bottom surface 118 of base 114. Strike body 124 has a rounded strike surface 125 to minimize the contact point with playing surface 50 thereby reducing a slapping sound that may occur during playing. Strike body 124 has a height of about ⅜ inches. Strike body 124 is made from wood and fabricated by conventional wood forming, cutting, and machining processes. Strike body 124 may be made from other materials such as metal, plastic, or a rubber pad.

With continued reference to FIGS. 3-5, pivot body 126 is secured to bottom surface 118 of base 114 at a position or pivot point between first end 120 of base 114 and strike body 124 by conventional means such as screws (not shown) that coincides or aligned with the position of the ankle of the foot 60 when resting upon foot board 104. Pivot body 126 spans the entire width of bottom surface 118 of base 114. Pivot body 126 has a rounded bottom surface 128 that assists in pivoting of base 114 relative to playing surface 50. Pivot body 126 has a height equal to the height of strike body 124, namely, about ⅜ inches. Pivot body 126 is made from wood and fabricated by conventional wood forming, cutting, and machining processes. Pivot body 126 may be made from other materials such as metal, plastic or rubber.

With continued reference to FIGS. 3-5, electronic sensing circuitry 130 comprises a printed circuit board 132 engaged with or mounted to top surface 116 of base 114 at a position substantially above pivot body 126. Printed circuit board 132 may be mounted by bosses (not shown) to top surface 116. Alternatively, printed circuit board 132 may be mounted within a plastic housing that is secured to top surface 116 of base 114. Electronic sensing circuitry 130 further comprises first and second vibration sensors 134 and 136 electrically mounted to printed circuit board 132. Sensors 134 and 136 generate different attributes to the wave form signal created by the impact that are modeled after the characteristics of a bass drum sound. The characteristics of a bass drum sound are "attack" and "sustain". The attack is a sharper tone that is created at the initial impact of the beater striking the bass drum head. The sustain is the fuller bass tone that is created by the resonance of the drumhead continuing to vibrate and generate sound after the initial strike. Vibration sensor 134 generates a signal signature similar to the attack sound of a traditional bass drum. Sensor 136 generates a signal signature similar to the sustain sound of a traditional bass drum. It is critical to the performance of device 100 that the resonant frequency of vibration sensor 134 is higher than the resonant frequency of vibration sensor 136. Specifically, the resonant frequency of sensor 134 is about 75 Hz., and the resonant frequency of vibration sensor 136 is about 60 Hz. As such, sensors 134 and 136 generates an electrical signal that better matches the sound wave signature of a bass drum being struck by a foot pedal beater. Vibration sensor 134 is a piezoelectric film sensor that is widely known and available. Vibration sensor 134 is available as part number "Minisense 100 Vibration Sensor" from Measurement Specialties, Inc., 1000 Lucas Way, Hampton, Va. 23666, USA (www.meas-spec.com). Vibration sensor 136 is a piezoelectric film sensor available as part number "LDT0-028K" from Measurement Specialties, Inc., 1000 Lucas Way, Hampton, Va. 23666, USA.

Device 100 further comprise an audio jack 138 secured or mounted to opening 110 of side board 106 by a jack nut 140. Device 100 further comprises a cable or shielded wire 142 electrically connecting vibration sensors 134 and 136 of electronic sensing circuitry 130 to audio jack 136. A connector (not shown) is mounted on printed circuit board 132 so that one end of cable 142 can be connected to vibration sensors 134 and 136 of electronic sensing circuitry 130 and the other end of cable 142 is connected directly to audio jack 138. Audio jack 138 is a ¼ inch audio jack that is widely known and available. Audio jack 138 is available as part number NMJ2HC-S from Neutrik AG, Im alten Riet 143, 9494 Schaan, Liechtenstein, Germany (www.neutrik.com). Other types of audio jacks may be employed such as a ¼ inch XLR combination audio jack which is widely known and available, for example, as part number NCJSFI-H-0 from Neutrik AG, Im alten Riet 143, 9494 Schaan, Liechtenstein, Germany.

Figure 6:
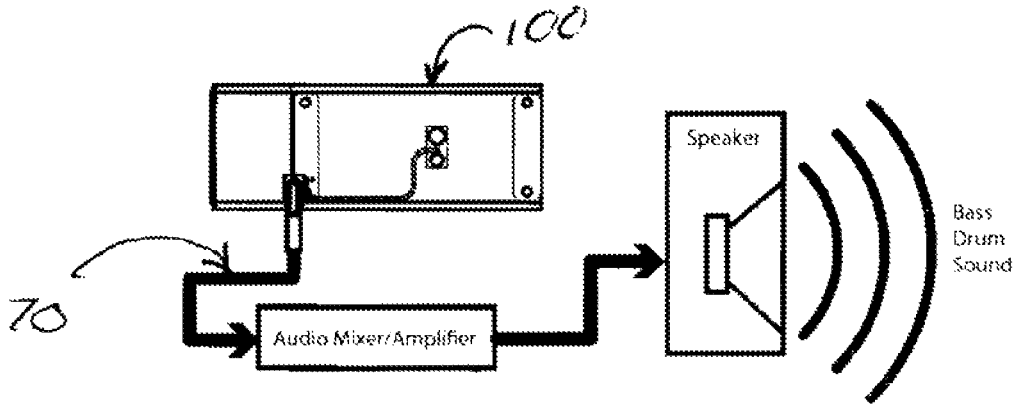
FIG. 6 is a block diagram illustrating a first application of the device according to the first embodiment of the present invention.
Figure 7:
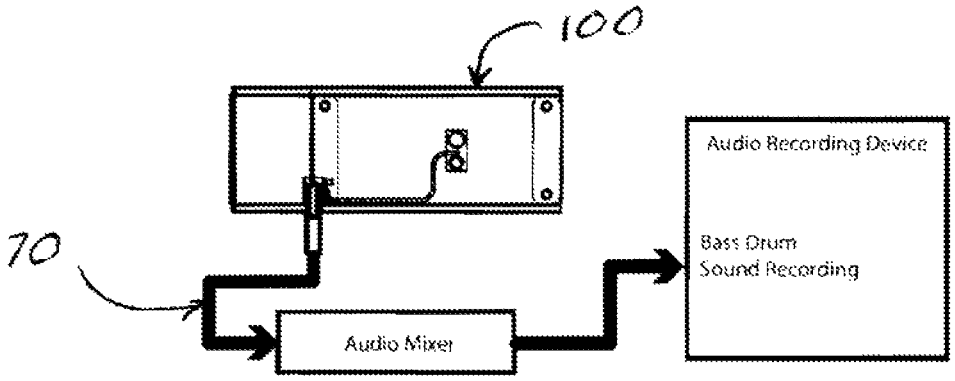
FIG. 7 is a block diagram illustrating a second application of the device according to the first embodiment of the present invention.
Figure 8:
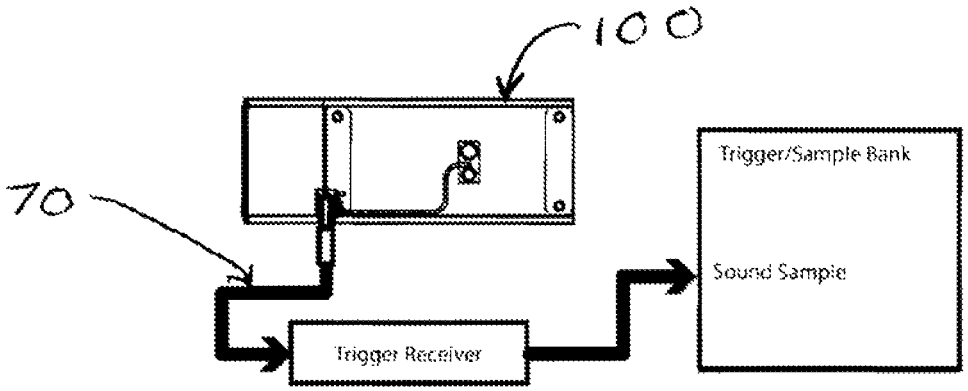
FIG. 8 is a block diagram illustrating a third application of the device according to the first embodiment of the present invention.

Referring to FIGS. 6-8, where various applications of device 100 are illustrated. Generally, to use device 100 of the present invention, one end of a cable 70 is plugged into audio jack 138 and the other end of cable 70 is plugged into a device of the musician's choice to receive the electrical signal such as an amplifier and/or audio mixing console. The musician places their left or right foot onto the footboard 104 and rocks their foot 60 back to raise strike body 124 as the whole device 100 tilts back on its pivot point about pivot body 126. The musician then reverses the motion to cause strike body 124 to impact playing surface 50. This impact causes sensors 134 and 136 of electronic sensing circuitry 130 to vibrate and generate a signal with its amplitude based on the severity of the impact. This signal is transmitted to an audio device plugged into audio jack 138 of device 100 where the signal is converted from an electrical signal to an acoustic signal. The musician repeats the rocking action with their foot 60 in a pattern based on the desired rhythm. FIG. 6 shows how device 100 can be used to generate an acoustical sound indicative of a base drum. Audio cable 70 is plugged into audio jack 138 of device 100. The other end of cable 70 is plugged into an audio mixer/amplifier. The mixer/amplifier is connected to a speaker that produces sounds. The signal generated by using device 100 travels through the mixer/amplifier where it is converted from an electrical signal to a bass drum acoustical sound. FIG. 7 shows how device 100 can be used to generate and record an acoustical sound indicative of a base drum. Audio cable 70 is plugged into audio jack 138 of device 100. The other end of cable 70 is plugged into an audio mixer. The mixer is connected to an audio recording device. The signal generated by using device 100 travels through the mixer to the recording device where the analog signal is recorded as a bass drum sound. FIG. 8 shows how device 100 can be used to trigger samples of pre-recorded drum sounds. Audio cable 70 is plugged into audio jack 138 of device 100. The other end of cable 70 is plugged into a trigger receiver. The receiver is connected to sample blank to assign a specific sound to the trigger input. The signal generated by using the device travels through the trigger receiver to the sample bank where a sound signal is generated to be amplified and heard or recorded.

Figure 9:
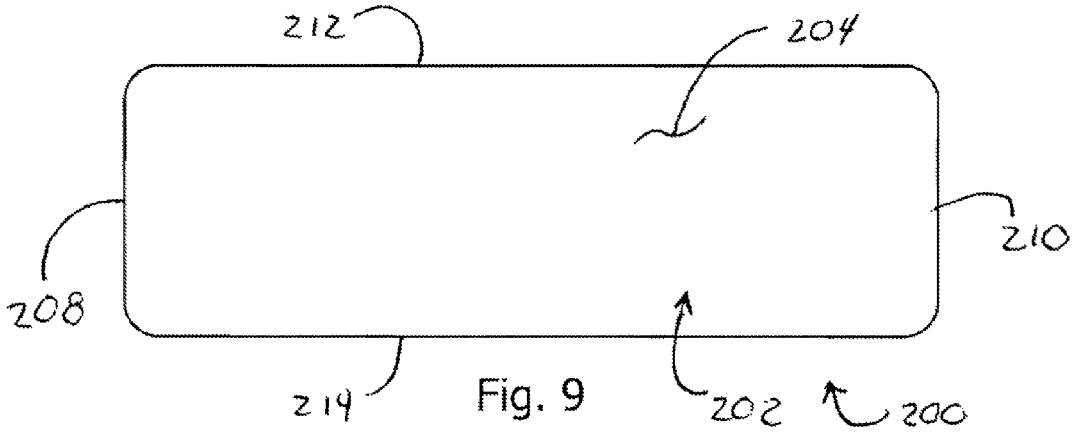
FIG. 9 is a top plan view of a device according to a second embodiment of the present invention.
Figure 10:
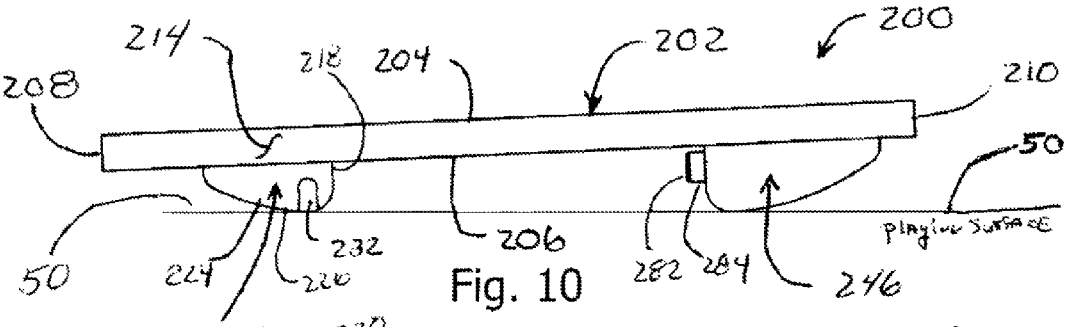
FIG. 10 is a side view of the device according to the second embodiment of the present invention.
Figure 11:
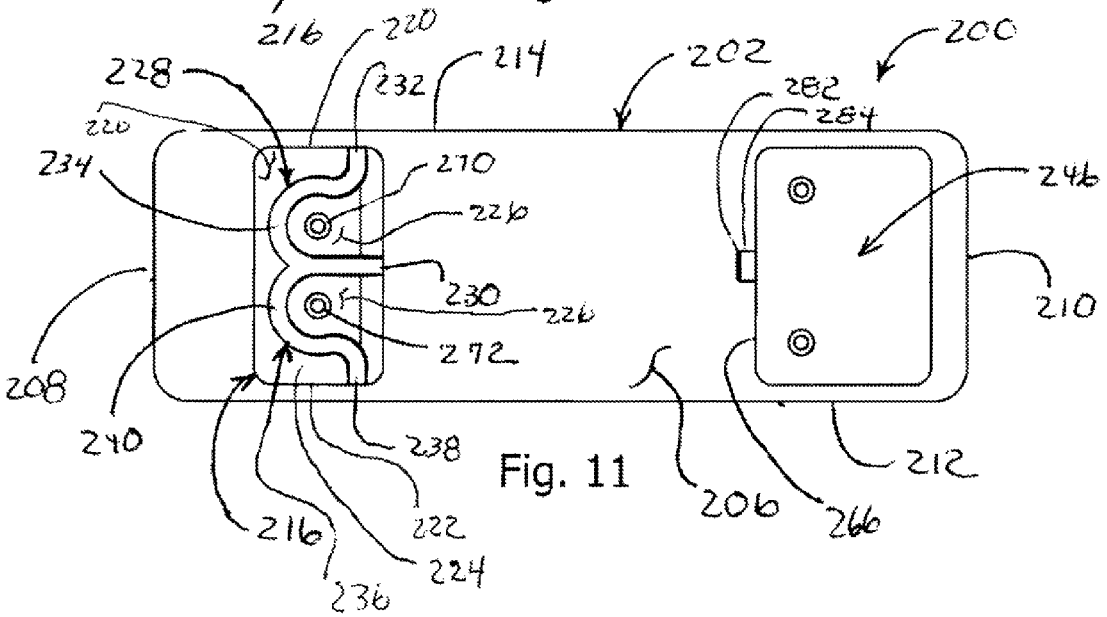
FIG. 11 is a bottom plan view of the device according to the second embodiment of the present invention.

Referring to FIGS. 9-11, a device 200 according to a second embodiment of the present invention is shown for use on a playing surface 50 by a musician having a foot 60 to generate an electrical signal indicative of a bass drum. Device 200 generally comprises an elongated board or base 202, a pivot body 216, and a strike body 246. Device 200 further comprises an electronic sensing circuitry 274 (to be described) that is mounted within strike body 246 to generate an electrical signal indicative of a bass drum when strike body 246 hits or impacts playing surface 50.

With continued reference to FIGS. 9-11, base 202 comprises substantially planar top and bottom surfaces 204 and 206, a first or rear end 208, a second or front end 210, and left and right sides 212 and 214. Top surface 204 is substantially parallel to bottom surface 206 and receives the foot (not shown) of a musician to actuate device 200. Bottom surface 206 is inclined about three (3) degrees to playing surface 50 to assist in pivoting of base 202 relative to playing surface 50 by rocking movement of the musician's foot. Base 202 is made from wood and fabricated by conventional wood forming, cutting, and machining processes. Base 202 may be made from other materials such as metal or plastic.

With continued reference to FIGS. 10-11, pivot body 216 is secured to bottom surface 206 of base 202 at a position inward from rear end 208 to provide a pivot point upon playing surface 50 that coincides or is aligned with the ankle of foot 60 when resting on top surface 204 of base 202. Pivot body 216 comprises a top portion 218 mounted to bottom surface 206 of base 202, side portions 220 and 222, and a bottom portion 224 in direct contact with playing surface 50. Bottom portion 224 comprises a rounded pivot surface 226 to assist in pivoting base 202 upon playing surface 50. Pivot body 216 further comprises mounting holes 270 and 272 that allow pivot body 216 to be secured to bottom surface 206 of base 202 by screws (not shown).

Figure 12:
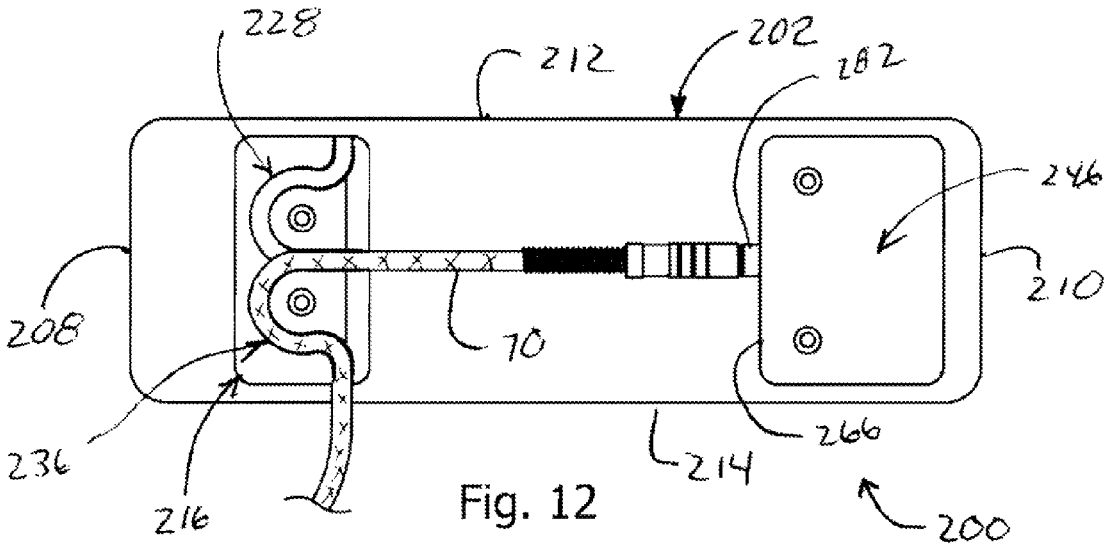
FIG. 12 is a bottom plan view of the device according to the second embodiment of the present invention showing an audio cable connected to an audio jack and passing through a first or left strain relief formed in a pivot body.
Figure 13:
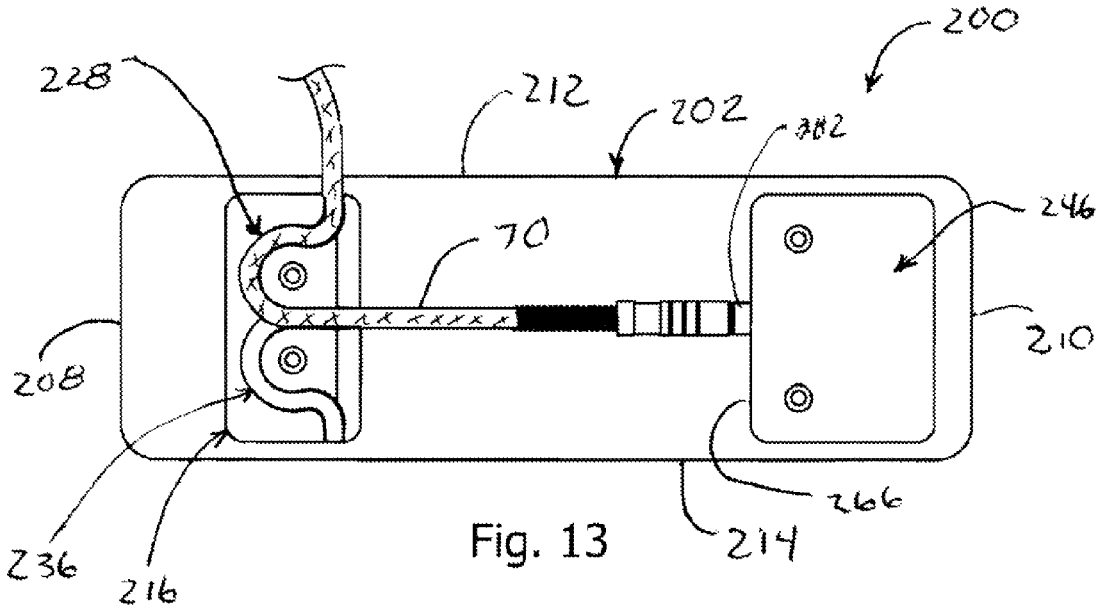
FIG. 13 is a bottom plan view of the device according to the second embodiment of the present invention showing the audio cable connected to the audio jack and passing through a second or right strain relief formed in the pivot body.
Figure 14:
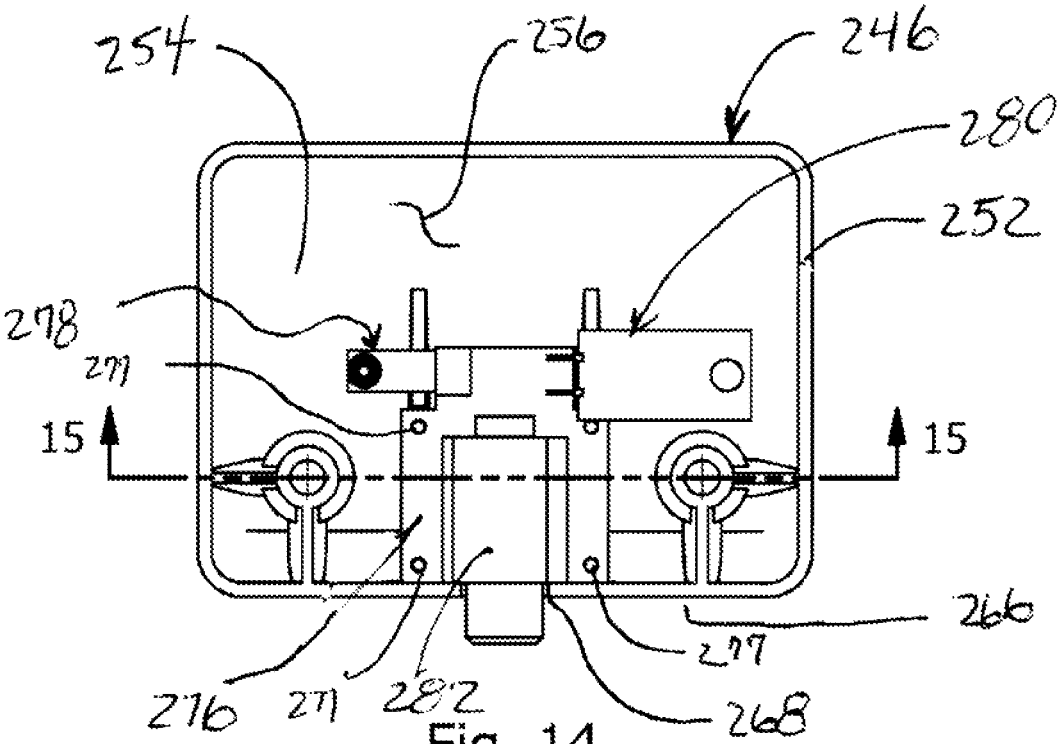
FIG. 14 is a bottom view of a strike body of the device according to the second embodiment of the present invention and an electronic circuit mounted within a cavity of the strike body.
Figure 15:
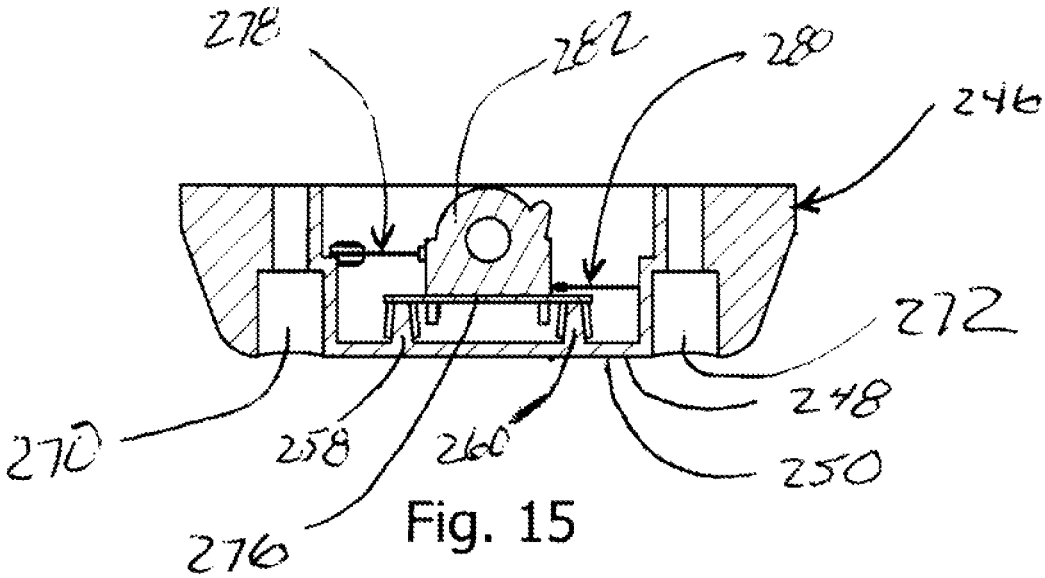
FIG. 15 is a cross-section view taken along line 15-15 of FIG. 14 showing a printed circuit board of the electronic circuit secured to a plurality of mounting bosses formed in a cavity of the strike body of the device according to the second embodiment of the present invention.

With reference to FIGS. 10 and 11, pivot body 216 further comprises first and second strain reliefs 228 and 236 formed in bottom portion 224. As will be described more full herein, device 200 further comprises an audio jack 282 as in device 100 of the first embodiment of the present invention. However, unlike device 100 of the first embodiment, audio jack 282 is mounted to a rear wall 254 (to be described) of strike body 246 by a jack nut 284 and to a printed circuit board 276 (to be described) of electronic sensing circuitry 274 (to be described). One end of cable 70 is plugged into audio jack 282 and the other end of cable 70 is plugged into a device of the musician's choice to receive the electrical signal such as an amplifier and/or audio mixing console. First and second strain reliefs 228 and 236 are provided to safely secure cable 70 as it passes from audio jack 282 to pivot body 216 and then outward of device 200. First strain relief 228 comprises a common inlet portion 230, an outlet portion 232, and a continuous channel 234 extending from inlet portion 230 to outlet portion 232. Second strain relief 236 comprises common inlet portion 230, an outlet portion 238, and a continuous channel 240 extending from inlet portion 230 to outlet portion 238. As shown by FIG. 12, cable 70 can be secured in second strain relief 236 that allows the other end of cable 70 to exit left side 214 of device 200. As shown, by FIG. 13, cable 70 can be secured in first strain relief 228 that allows cable 70 to exit right side 212 of device 200. Pivot body 216 has a height of about ¾ inches measured from bottom portion 224 to top portion 218. The height of pivot body 216 is smaller than the height of strike body 246 to position base 202 at an inclined angle of about three (3) degrees to playing surface 50 during use of device 200. Pivot body 216 is made from a polymer or hard rubber material such as polyurethane and fabricated by well known molding processes. Pivot body 216 may be made from other material such as wood, metal or plastic.

Referring to FIGS. 10-11 and 14-15, strike body 246 is secured to bottom surface 206 of base 202 at a position inward from second or front end 210. Strike body 246 comprises a lower portion 248 having a rounded strike surface 250 and an upper portion 252 that is secured to bottom surface 206 of base 202. Rounded strike surface 250 minimizes the contact point with playing surface 50 thereby reducing a slapping sound that nay occur during playing. Strike body 246 further comprises mounting holes 270 and 272 to secure strike body 246 to bottom surface 206 of base 202 by conventional fasteners such as screws (not shown). Strike body 246 further comprises a cavity 254 having a floor 256 and mounting bosses 258 and 260 adapted to receive printed circuit board 276 (to be described) of electronic sensing circuitry 274 (to be described). Strike body 246 further comprises a rear wall 266 having an opening 268 to receive audio jack 282 which is secured to rear wall 266 by jack nut 284. The height of strike body 246 is larger than the height of pivot body 216 to position base 202 at an inclined angle of about three (3) degrees relative to playing surface 50. Strike body 246 has a height of about one (1) inch measured from strike surface 250 to upper portion 252. Strike body 246 is made from a hard rubber material such as polyurethane and fabricated by well known molding processes. Strike body 246 may be made from other material such as wood, metal or plastic.

Figure 17:
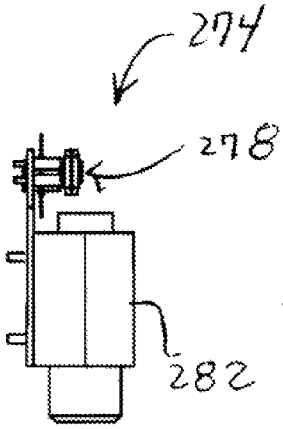
FIG. 17 is a side view of the electronic sensing circuitry of the device according to the second embodiment of the present invention.
Figure 16:
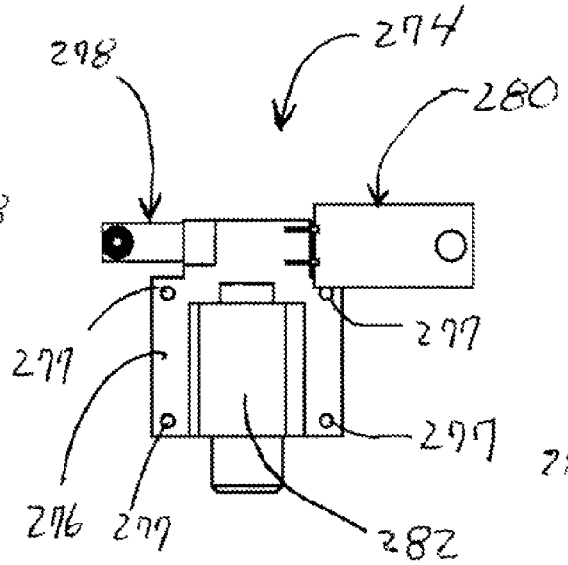
FIG. 16 is a top plan view of the electronic sensing circuitry of the device according to the second embodiment of the present invention.
Figure 18:
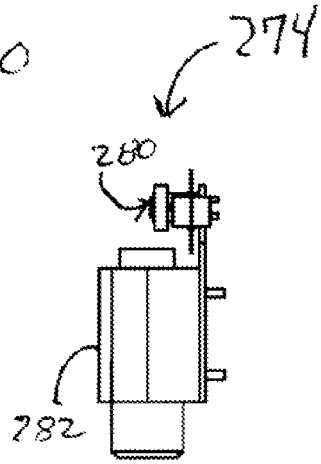
FIG. 18 is a side view of the electronic sensing circuitry of the device according to the second embodiment of the present invention.

Referring to FIGS. 16-18, electronic sensing circuitry 274 comprises a printed circuit board 276 having mounting holes 277 that are secured to bosses 258 and 260 of strike body 246 by conventional fasteners such as screws (not shown). Electronic sensing circuitry 274 further comprises a first sensor 278 and a second sensor 280 mounted to printed circuit board 276 by conventional soldering processes. Sensors 278 and 280 are identical to sensors 134 and 136 of device 100 of the first embodiment. It is critical to the performance of device 200 that the resonant frequency of sensor 278 is higher than the resonant frequency of vibration sensor 180. The resonant frequency of vibration sensor 134 is about 75 Hz., and the resonant frequency of vibration sensor 136 is about 60 Hz. Vibration sensor 278 is a piezoelectric film sensor available as part number "Minisense 100 Vibration Sensor" from Measurement Specialties, Inc., 1000 Lucas Way, Hampton, Va. 23666, USA (www.meas-spec.com). Vibration sensor 280 is a piezoelectric film sensor available as part number "LDT0-028K" from Measurement Specialties, Inc., 1000 Lucas Way, Hampton, Va. 23666, USA.

With continued reference to FIGS. 10-11 and 16-18, device 200 further comprises an audio jack 282 mounted directly to printed circuit board 276 by conventional soldering processes and electrically connected to vibration sensors 278 and 280. As discussed heretofore, audio jack 282 is mounted thru opening 268 of rear wall 266 of strike body 246 and secured thereto by jack nut 284. Audio jack 282 is a ¼ inch audio jack is widely known and available. Audio jack 282 is available as part number M Series NMJ2HC-S from Neutrik AG, Im alten Riet 143, 9494 Schaan, Liechtenstein, Germany (www-.neutrik.com). Other types of audio jacks may be employed such as a ¼ inch XLR combination audio jack which is widely known and available, for example, as part number NCJ5FI-H-0 from Neutrik AG, Im alten Riet 143, 9494 Schaan, Liechtenstein, Germany.

Figure 19:
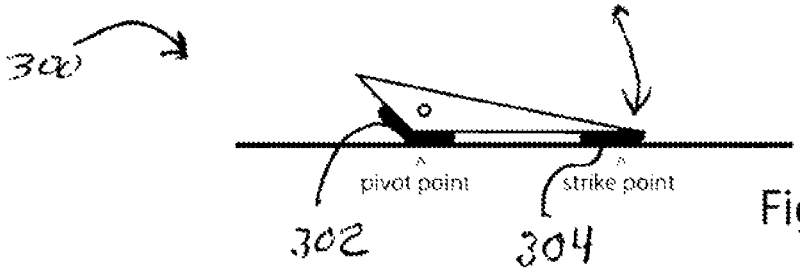
FIG. 19 is a side view showing a device according to a third embodiment of the present invention.

Referring to FIG. 19, where a device 300 according to a third embodiment of the present invention is illustrated. Device 300 is similar to device 100 except the pivot body and the strike body have been replaced with rubber pivot pad 302 and rubber strike pad 304.

Figure 20:
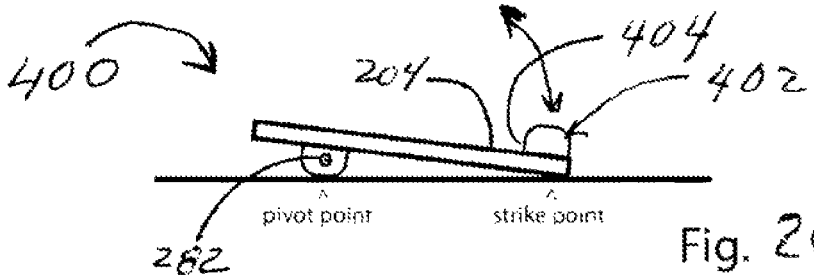
FIG. 20 is a side view showing a device according to a fourth embodiment of the present invention.

Referring to FIG. 20, where a device 400 according to a fourth embodiment of the present invention is illustrated. Device 400 is similar to device 200 except electrical sensing circuitry 274 is mounted within a housing 402 secured to top surface 204. Similar to device 200, audio jack 282 may be mounted to a wall 404 of housing 402.

Figure 21:
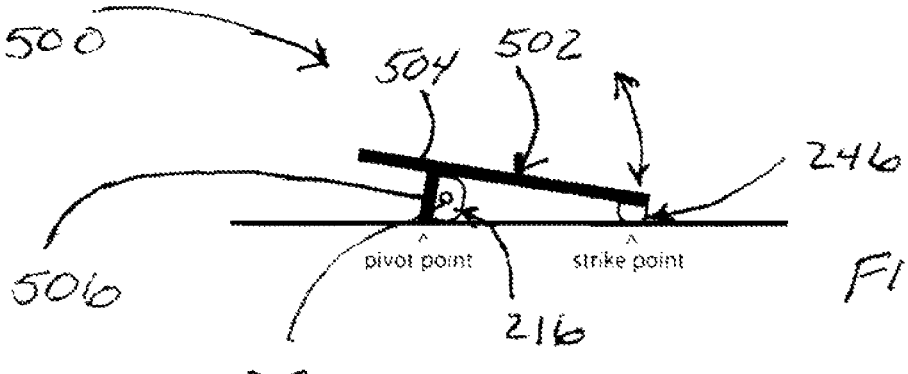
FIG. 21 is a side view showing a device according to a fifth embodiment of the present invention.

Referring to FIG. 21, where a device 500 according a fifth embodiment of the present invention is illustrated. Device 500 is the same as device 200 except that base 202 has been replaced with an extruded body 502 having an elongated base 504 and a leg 506. Leg 506 is substantially perpendicular to base 504. Strike body 246 having electronic sensing circuitry 274 mounted therein is secured to base 504. Pivot body 216 is mounted to leg 506. A cable (not shown) electrically connects electronic sensing circuitry 274 (not shown) and audio jack 282 (not shown), and may be disposed in strains reliefs 228 and 236 (not shown) of pivot body 216.

Figure 22:
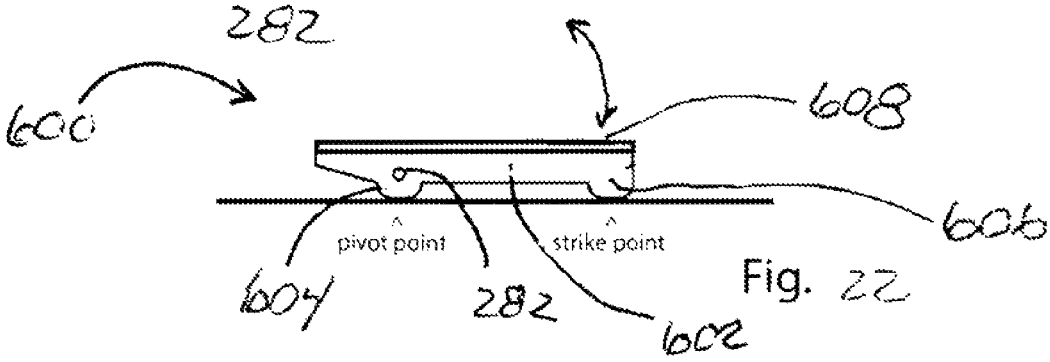
FIG. 22 is a side view showing a device according to a sixth embodiment of the present invention.

Referring to FIG. 22, where a device 600 according to a fifth embodiment of the present invention is illustrated. Device 600 is similar to devices 100 and 200 except that an one-piece unitary base 602 of any desired shape can be formed to mount electronic sensing circuitry 274 (not shown) and audio jack 282 (not shown) and to have a pivot body 604 and a strike body 606. A foot board 608 can be attached to base 602. Audio jack 282 is mounted within pivot body 604 and electronic sending circuitry 274 is mounted within a cavity (not shown) close to strike body 506.

Devices 100 and 200 and the other embodiments of the present invention provide significant advantages over conventional stomp boxes. First, devices 100 and 200 are ergonomically designed to reduce strain on the musician's shin and ankle. The specific geometry of the invention promotes a physical movement when playing that requires less energy and muscular exertion, reducing the strain in the shin and ankle that is experienced when playing traditional stomp boxes. Second, devices 100 and 200 better matches the motion of actually playing a bass drum with a pedal. Traditional bass drum pedals have a platform that stays in contact with the bottom of the foot. This constant contact gives the user better control over the timing and volume while playing the bass drum. Traditional stomp boxes are played by tapping the foot on the device where the foot and device lose contact. Tapping the foot is a less controlled motion than rocking the entire device and maintaining contact between the foot and device. Third, devices 100 and 200 generate an electrical signal that better matches the sound wave signature of a bass drum being struck by a foot pedal beater. The low and high frequency sensors of the present invention vibrate at their own frequency when a strike is administered. Bass drums create their distinct sound when a beater strikes the head causing the head to vibrate generating sound. Traditional stomp boxes use a sensor that picks up the vibration of what it is attached to. This signal requires processing and effects to make it sound like a bass drum.

The foregoing description is intended primarily for purposes of illustration. This invention may be embodied in other forms or carried out in other ways without departing from the spirit or scope of the invention as claimed.

What is claimed:

1. A device for use on a playing surface by a musician using a foot to generate an electrical signal indicative of a bass drum, the device comprising:

a body comprising a base having top and bottom surfaces and first and second ends;

a strike body secured to said bottom surface of said base at a position inward from said second end;

a pivot body secured to said bottom surface of said base at a position inward from said first end; said pivot body is adapted to rest upon the playing surface allowing said base to pivot relative to the playing surface between a first position where said strike body is off the playing surface and a second position where said strike body hits the playing surface; and electronic sensing circuitry engaged with said body; said electronic sensing circuitry is adapted to generate an electrical signal indicative of a base drum in response to said strike body hitting the playing surface; said electronic circuitry comprising first and second vibration sensors; said first and second vibration sensors each have a resonant frequency; said resonant frequency of said first vibration sensor is higher than said resonant frequency of said second vibration sensor.

2. The device of claim 1, wherein said electronic sensing circuitry further comprises an audio jack electrically connected with said first and second sensors to receive and output said electrical signal.

3. The device of claim 2, wherein said audio jack is engaged with said body and electrically connected to said first and second vibration sensors.

4. The device of claim 3, wherein said electronic sensing circuitry further comprises a printed circuit board engaged with said base and first and second vibration sensors mounted to said printed circuit board; said audio jack is mounted to said printed circuit board.

5. The device of claim 4, wherein said strike body comprises a cavity; said electronic sensing circuitry being mounted within said cavity.

6. The device of claim 5, wherein said base is substantially planar and inclined from said pivot body to said strike body.

7. The device of claim 6, wherein said pivot body comprises a first strain relief having an inlet portion facing said strike body; said pivot body comprises a second strain relief having an inlet portion facing said strike body.

8. The device of claim 7, wherein said top surface of said base is adapted to receive the foot of the musician to pivot said body between said first and second positions.

9. The device of claim 3, wherein said body further comprises first and second side boards engaged with said base and a foot board engaged with said first and second side board and extending outward of said first end; said foot board is substantially planar and is adapted to receive the foot of the musician to pivot said body between said first and second positions.

10. The device of claim 9, wherein said foot board is inclined to said base to assist in pivoting of said base between said first and second positions.

11. The device of claim 10, wherein said audio jack is mounted to said first side board.

12. The device of claim 1, wherein said first and second vibration sensors are piezoelectric film sensors.

13. The device of claim 2, wherein said audio jack is a ¼ inch audio jack.

14. The device of claim 1, wherein said base is made from wood.

15. The device of claim 1, wherein said pivot body and said strike body are each made from plastic.

16. A device for use on a playing surface by a musician using a foot to generate an electrical signal indicative of a bass drum, the device comprising:

a body comprising a base having top and bottom surfaces and first and second ends;

a strike body secured to said bottom surface of said base at a position inward from said second end;

a pivot body secured to said bottom surface of said base at a position inward from said first end; said pivot body is adapted to rest upon the playing surface allowing said base to pivot relative to the playing surface between a first position where said strike body is off the playing surface and a second position where said strike body hits the playing surface; said pivot body comprises a first strain relief having an inlet portion facing said strike body; and electronic sensing circuitry engaged with said body; said electronic sensing circuitry is adapted to generate an electrical signal indicative of a base drum in response to said strike body hitting the playing surface.

17. The device of claim 16, wherein said pivot body comprises a second strain relief having an inlet portion facing said strike body.

18. The device of claim 17, wherein said top surface of said base is adapted to receive the foot of the musician to pivot said body between said first and second positions.

* * * * *